US010072369B2

(12) United States Patent
Galea et al.

(10) Patent No.: US 10,072,369 B2
(45) Date of Patent: Sep. 11, 2018

(54) LAUNDRY TREATING APPLIANCE FOR LIMITING WATER USAGE IN SMALL LOADS

(71) Applicant: WHIRLPOOL CORPORATION, Benton Harbor, MI (US)

(72) Inventors: Sarah Galea, St. Joseph, MI (US); Christopher A. Jones, Saint Joseph, MI (US); Aaron A. Linden, Sandwich, IL (US); Thomas D. Spicer, St. Joseph, MI (US); Meredith A. Wagner, St. Joseph, MI (US); Robert C. Williams, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 170 days.

(21) Appl. No.: 15/139,634

(22) Filed: Apr. 27, 2016

(65) Prior Publication Data

US 2017/0314178 A1 Nov. 2, 2017

(51) Int. Cl.

| | |
|---|---|
| ***D06F 23/04*** | (2006.01) |
| ***D06F 29/02*** | (2006.01) |
| ***D06F 39/08*** | (2006.01) |

(52) U.S. Cl.

CPC ..... *D06F 23/04* (2013.01); *D06F 29/02* (2013.01); *D06F 39/083* (2013.01)

(58) Field of Classification Search

CPC ..... D06F 23/05; D06F 29/02; D06F 39/083; D06F 37/12

USPC ..... 68/23 R, 23.4, 148, 12.19, 208, 23.3, 68/12.14, 19.2; 210/380.2, 147, 360.1, 210/145, 130, 371

See application file for complete search history.

(56) References Cited

U.S. PATENT DOCUMENTS

| | | | | | |
|---|---|---|---|---|---|
| 2,553,581 | A * | 5/1951 | Hatfield | D06F 17/12 | 210/139 |
| 2,641,918 | A * | 6/1953 | Smith | D06F 33/02 | 210/127 |
| 2,656,700 | A * | 10/1953 | Smith | D06F 13/02 | 137/56 |
| 2,711,827 | A * | 6/1955 | Smith | D06F 37/12 | 137/47 |
| 2,748,788 | A * | 6/1956 | Duckstein | B04B 11/00 | 137/527 |
| 3,296,839 | A * | 1/1967 | Lornitzo | D06F 23/02 | 210/144 |
| 3,382,882 | A * | 5/1968 | McLawhorn | D06F 23/04 | 137/53 |
| 5,249,441 | A * | 10/1993 | Pastryk | D06F 37/12 | 210/147 |
| 5,582,040 | A * | 12/1996 | Khan | D06F 37/225 | 210/144 |

(Continued)

FOREIGN PATENT DOCUMENTS

GB 660292 A 11/1951

*Primary Examiner* — David G Cormier
*Assistant Examiner* — Thomas Bucci

(57) ABSTRACT

A laundry treating appliance for treating laundry according to a cycle of operation includes a rotatable basket defining a laundry treating space and having a bottom wall and a side wall. The bottom wall of the rotatable basket includes at least one drain hole. A centrifugally actuated valve comprising a weighted ball is positioned to selectively open and close the at least one drain hole as the basket rotates.

15 Claims, 5 Drawing Sheets

(56) References Cited

U.S. PATENT DOCUMENTS

| | | | | |
|---|---|---|---|---|
| 6,327,732 | B1 * | 12/2001 | Braunschweig | D06F 37/245 210/144 |
| 2010/0050700 | A1 * | 3/2010 | Bongini | D06F 37/206 68/139 |
| 2011/0005277 | A1 * | 1/2011 | Hasanreisoglu | D06F 37/065 68/12.06 |
| 2013/0036774 | A1 * | 2/2013 | Kim | D06F 37/26 68/142 |

* cited by examiner

LAUNDRY TREATING APPLIANCE FOR LIMITING WATER USAGE IN SMALL LOADS

BACKGROUND

Laundry treating appliances, such as washing machines, clothes dryers, refreshers, and non-aqueous systems, can have a configuration based on a rotating container that at least partially defines a treating chamber in which laundry items are placed for treating. Traditionally, in a vertical axis washing machine, the container is a perforated basket with perforations provided along the full height of the basket, which is located within an imperforate tub, with both the basket and tub typically having an upper opening at their respective ends. The tub surrounds the basket and generally has a height as tall as or taller than the basket to catch water exiting the perforations of the basket for the full height of the basket. During a wash or rinse cycle, water is able to flow freely through the perforations of the basket, requiring the volume of the wash or rinse water to be sufficient not only to fill the basket to a predetermined level with liquid, but also to fill the imperforate tub to the same predetermined level with liquid. Thus, even with small laundry loads, the volume of water required during a wash or rinse cycle must be greater than what would be required just to fill the basket to the predetermined level if water were not able to flow out of the basket through the perforations.

BRIEF SUMMARY

A laundry treating appliance for treating laundry according to a cycle of operation includes a rotatable basket defining a laundry treating space. The rotatable basket also includes one or more drain holes. A centrifugally-actuated valve comprising a weighted object is configured to close the drain hole while rotation of the rotatable basket is below a first rotational speed, and move away from and open the drain hole as rotation of the rotatable basket approaches a second rotational speed greater than the first rotational speed.

A valve assembly for a rotatable basket in a laundry treating appliance includes a housing, a compression spring within the housing, and a weighted object adjacent the compression spring. At least a portion of the weighted object projects from the housing. The housing is shaped and dimensioned to mount to the rotatable basket adjacent a drain hole. The compression spring and the weighted object are disposed at an oblique angle relative to the drain hole so that the weighted object can move toward and close the drain hole while rotation of the rotatable basket is below a first rotational speed. The weighted object moves away from and opens the at least one drain hole as rotation of the rotatable basket approaches a second rotational speed that is greater than the first rotational speed.

A method of assembling a laundry treating appliance for treating laundry according to a cycle of operation includes providing one or more drain holes in a rotatable basket. A valve assembly is also provided that includes a housing, a spring within the housing, and a weighted object adjacent the spring, a portion of which projects from the housing. The valve assembly is mounted adjacent to the drain hole. The weighted object is positioned to move toward and close the drain hole while rotation of the rotatable basket is below a first rotational speed. The weighted object moves away from and opens the drain hole as rotation of the rotatable basket approaches a second rotational speed that is greater than the first rotational speed.

DETAILED DESCRIPTION

Figure 1:
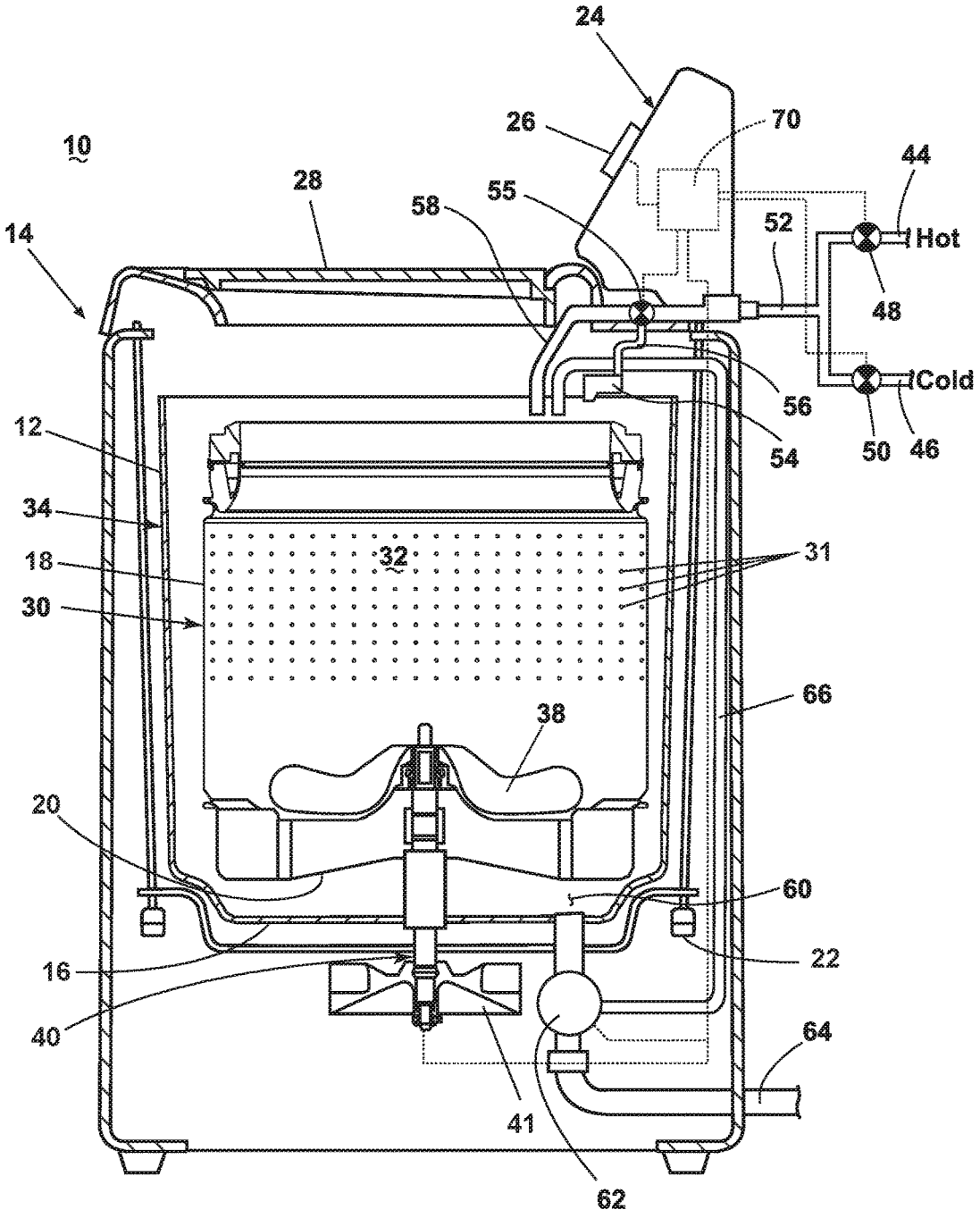
FIG. 1 illustrates a partially schematic cross-sectional view of a laundry treating appliance in the form of a washing machine according to an illustrative embodiment of the present disclosure.

FIG. 1 is a schematic sectional view of a laundry treating appliance in the form of a washing machine 10 according to one embodiment of the invention. While the laundry treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

The washing machine 10 can include a structural support system comprising a cabinet 14 that defines a housing, within which a laundry holding system resides. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the invention.

A user interface 24 may be included on the cabinet 14 and may have one or more knobs, dials, switches, displays, touch screens and the like for communicating with the user, such as to receive input and provide output. The user can enter different types of information including, without limitation, cycle selection and cycle parameters, such as cycle options. A door or lid 28 may be operably coupled with the cabinet 14 and may be selectively moveable between opened and closed positions to close an opening in a top wall of the cabinet 14, which provides access to the interior of the cabinet 14.

The fabric holding system of the illustrated exemplary washing machine 10 can include a rotatable basket 30 having an open top that can be disposed within the interior of the cabinet 14 and may define a treating chamber 32 for receiving laundry items for treatment. An imperforate tub 34 can also be positioned within the cabinet 14 and can define an interior within which the basket 30 can be positioned. The tub 34 can have a generally cylindrical side or tub peripheral wall 12 closed at its bottom end by a base 16 that can at least partially define a sump 60. The basket 30 can have a generally peripheral wall 18, which is illustrated as a cylindrical side wall, closed at the basket end by a basket bottom wall 20 to at least partially define the treating chamber 32.

The basket 30 can be rotatably mounted within the tub 34 for rotation about a vertical basket axis of rotation and can include a plurality of perforations 31, such that liquid may flow between the tub 34 and the rotatable basket 30 through the perforations 31. In the exemplary embodiment illustrated herein, the perforations 31 are only present within an upper portion of the basket side wall 18, leaving a lower portion of the basket side wall 18 imperforate. The imperforate portion of the side wall 18 may be, for example, one third to one half of the total height of the basket side wall 18. It is also contemplated that any suitable arrangement of perforations 31 can be employed, non-limiting examples of which include having no perforations 31 within the basket side wall 18, or having only a portion of the basket side wall 18 provided with perforations 31 at any suitable location along the height of the basket side wall 18.

A laundry mover 38 may be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator. The basket 30 and the laundry mover 38 may be driven by a drive system 40 that includes a motor 41 operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be provided to supply liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the cabinet 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The controller 80 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
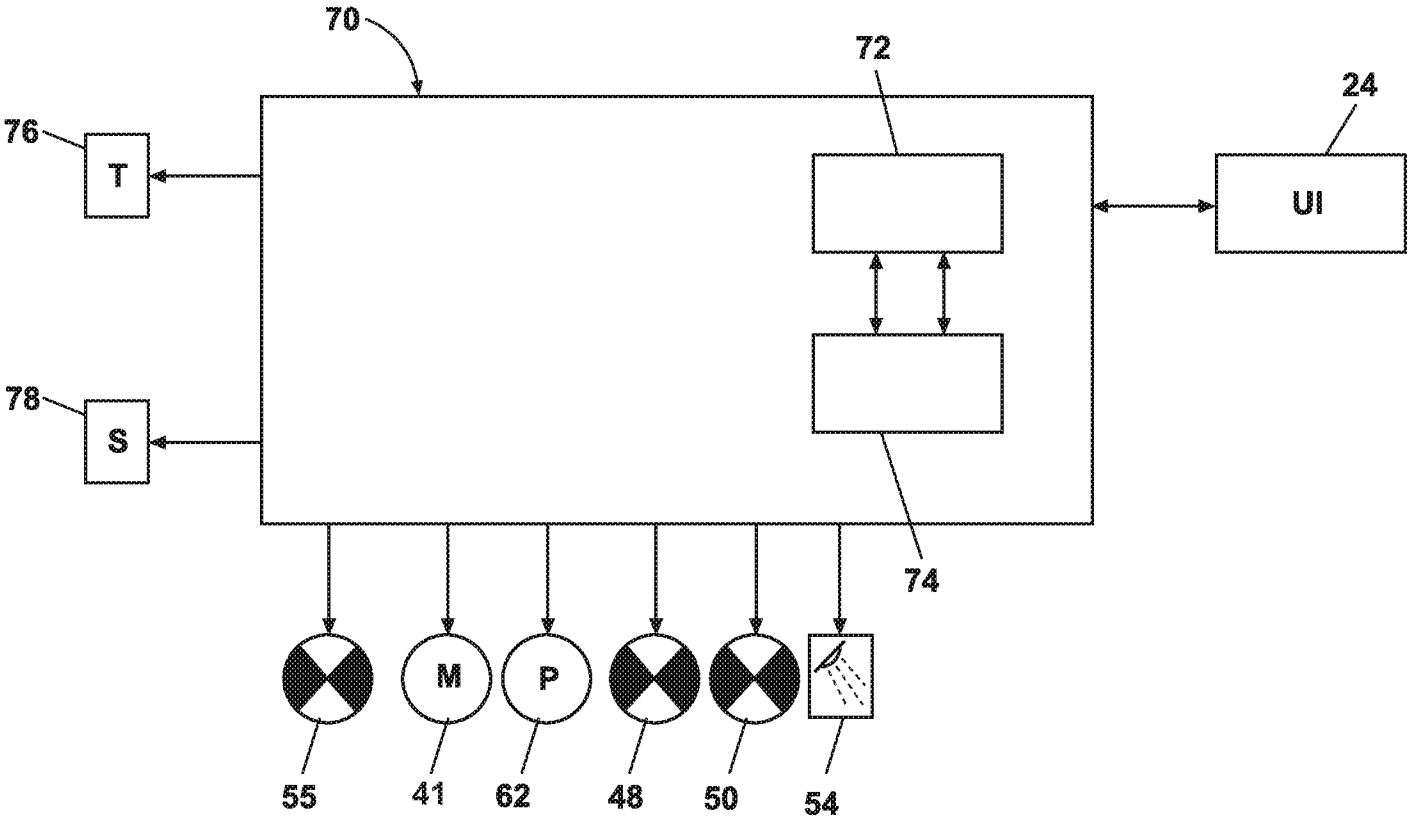
FIG. 2 illustrates a schematic representation of a controller for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, the diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
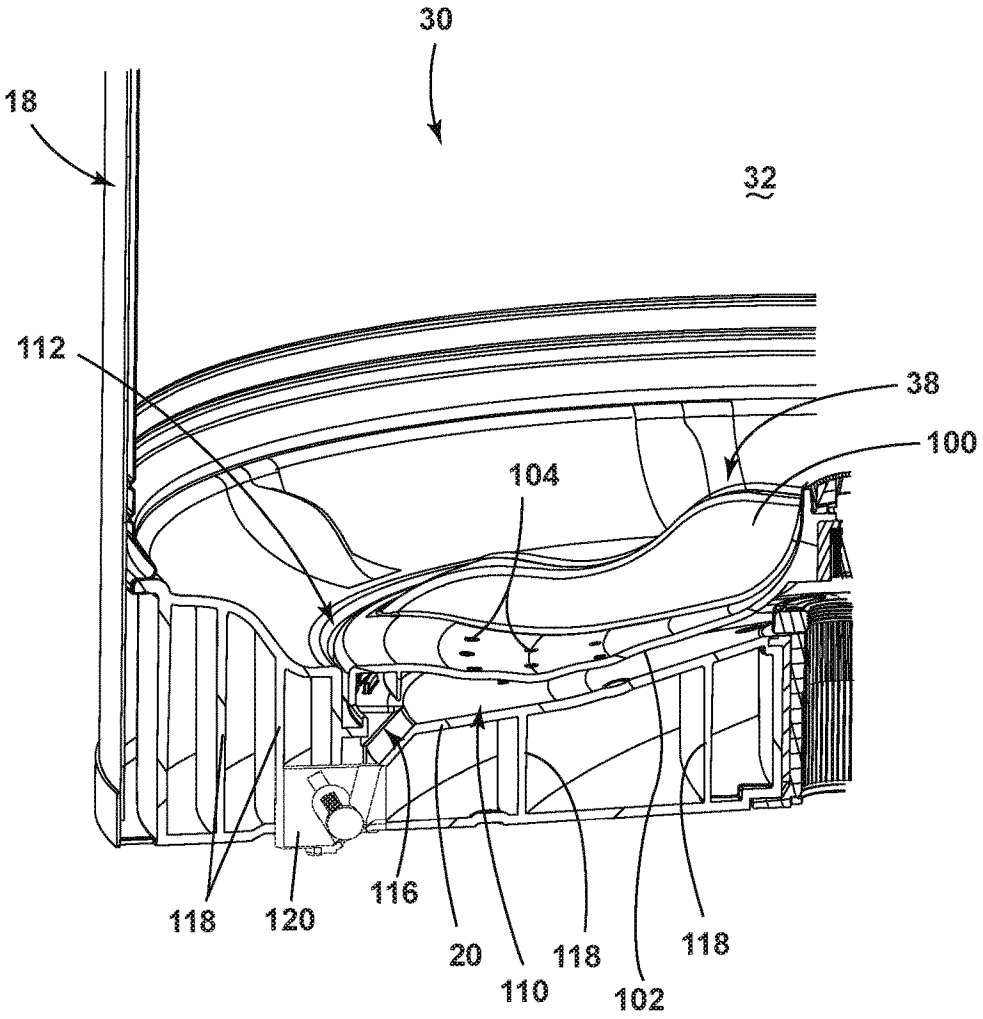
FIG. 3 illustrates an enlarged cross-sectional view of a basket and valve assembly for use with the washing machine of FIG. 1 according to an illustrative embodiment of the present disclosure.

Turning to FIG. 3, the laundry mover 38 can comprise an impeller 100 and a plate 102, the plate 102 comprising a plurality of plate holes 104. A gap 110 is defined between the plate 102 and the upper surface of the basket bottom wall 20, the gap 110 being in fluid communication with the treating chamber 32 through the plate holes 104. Additionally, an annular basket channel 112 is defined between the outer edge of the plate 102 and the basket bottom wall 20. The basket bottom wall 20 further comprises a plurality of base walls 118 providing structural rigidity. A plurality of through holes, shown as basket drain holes 116, are also disposed within the basket bottom wall 20, with the basket drain holes 116 in fluid communication with both the gap 110 and the basket channel 112.

A plurality of discrete valve assemblies 120 can mount to or within the lower surface portion of the basket bottom wall 20, corresponding to and surrounding each basket drain hole 116. The valve assemblies 120 are positioned such that wash liquid collected in the bottom of the basket 30 can only drain out of the basket 30 and into the tub 34 by passing through the valve assemblies 120. While the valve assemblies 120 comprise a generally square or rectangular cross section, different valve assemblies 120 that are adapted to accommodate each basket drain hole 116 are contemplated. It is contemplated that the valve assembly 120 can be any shape, unique or otherwise, defining any cross section, being sufficient to surround the basket drain holes 116. Depending on the shapes of the basket bottom wall 20 and the basket drain holes 116, the valve assembly 120 can be a plurality of shapes, being variable, unique, or rounded in non-limiting examples. While the valve assemblies 120 are illustrated herein as being integrated with the bottom wall 20 of the basket 30, it is also contemplated that the valve assembly 120 can be assembled within a washing machine 10 as a separate module. In this case, the rotatable basket 30 would be provided with at least one basket drain hole 116 within the bottom wall 20 of the basket 30. The valve assembly 120 can then be mounted adjacent the at least one basket drain hole 116.

Figure 4A:
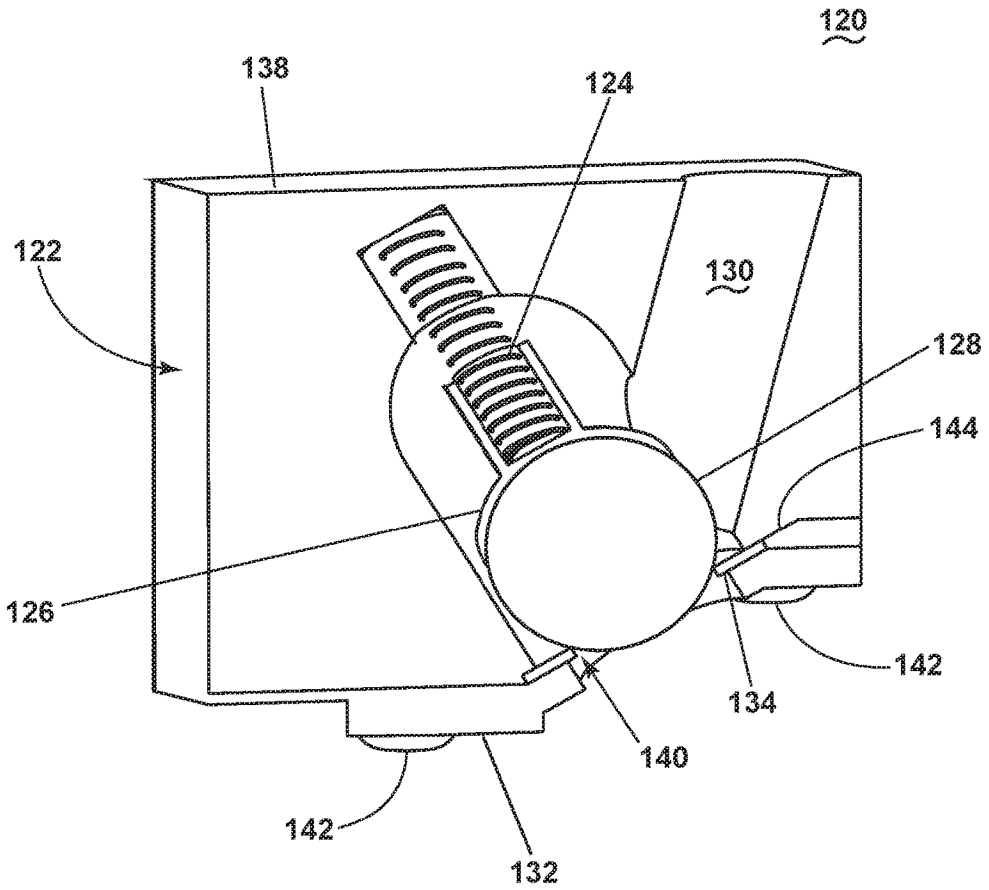
FIG. 4A illustrates an enlarged cross-sectional view of the of the valve assembly of FIG. 3 in a closed position.

Turning now to FIG. 4A, the details of the valve assembly 120 in a closed position are best seen. Each valve assembly 120 comprises a housing 122, a spring 124, a ball support 126, a weighted ball 128, a drain channel 130, a membrane seal 134, and a seal cap 132. The housing 122 is illustrated herein as having a generally rectangular cross-section, with the lower corner where the drain channel 130 terminates is cut off in an angled surface 144, which is provided at an oblique angle to the horizontal upper surface 138 of the housing 122. The upper surface 138 of the housing 122 of the valve assembly 120 is in fluid connection with the corresponding basket drain hole 116.

A membrane seal 134 is provided that surrounds the lower end of the drain channel 130. The membrane seal 134 is illustrated herein as having a square or rectangular shape with a circular through opening 140 in the middle. It is also contemplated that the membrane seal 134 could have any other suitable shape, non-limiting examples of which include circular, oblong, or any other geometry. The membrane seal 134 is held in place against the angled surface 144 of the housing 122 by a seal cap 132 and is positioned such that the membrane seal 134 is held at an angle relative to the plane of the basket drain hole 116. The seal cap 132 follows the profile of the angled surface 144 of the housing 122, with horizontal portions at either end that accommodate at least one attachment mechanism 142 that attaches the seal cap 132 to the housing 122. While the attachment mechanism 142 is illustrated herein as being in the form of a screw, any suitable attachment method is also contemplated, non-limiting examples of which include other fasteners, adhesives, welding, molding, etc.

A weighted ball 128 is provided within the housing 122 and positioned such that the weighted ball 128 can close off the through opening 140 of the membrane seal 134 and prevent wash liquid from exiting the drain channel 130. It will be understood that the weighted ball 128 need not be formed in a ball shape, but could have any other shape such that it can suitably close off the through opening 140 of the membrane seal 134. The weighted ball 128 can be formed of any material having sufficient weight to form a watertight seal with the membrane seal 134, non-limiting examples of which include stainless steel, other metals, or weighted plastics. The weighted ball 128 is biased against the membrane seal 134 by means of a ball support 126 that is held in place by the force of a spring 124. When the weighted ball 128 is occupying the closed position and is biased against the membrane seal 134, at least a portion of the weighted ball 128 projects from the housing 122. The spring 124 and the weighted ball 128 are oriented on an oblique axis relative to the basket drain hole 116. The spring 124, illustrated herein as a compression spring 124, could also be any other suitable type of spring or biasing mechanism. The ball support 126 is illustrated herein as having a profile that is complementary to that of the weighted ball 128. It is also contemplated that the ball support 126 could have any other suitable alternate shape that would effectively contact the weighted ball 128 in order to bias the weighted ball 128 against the membrane seal 134.

Figure 4B:
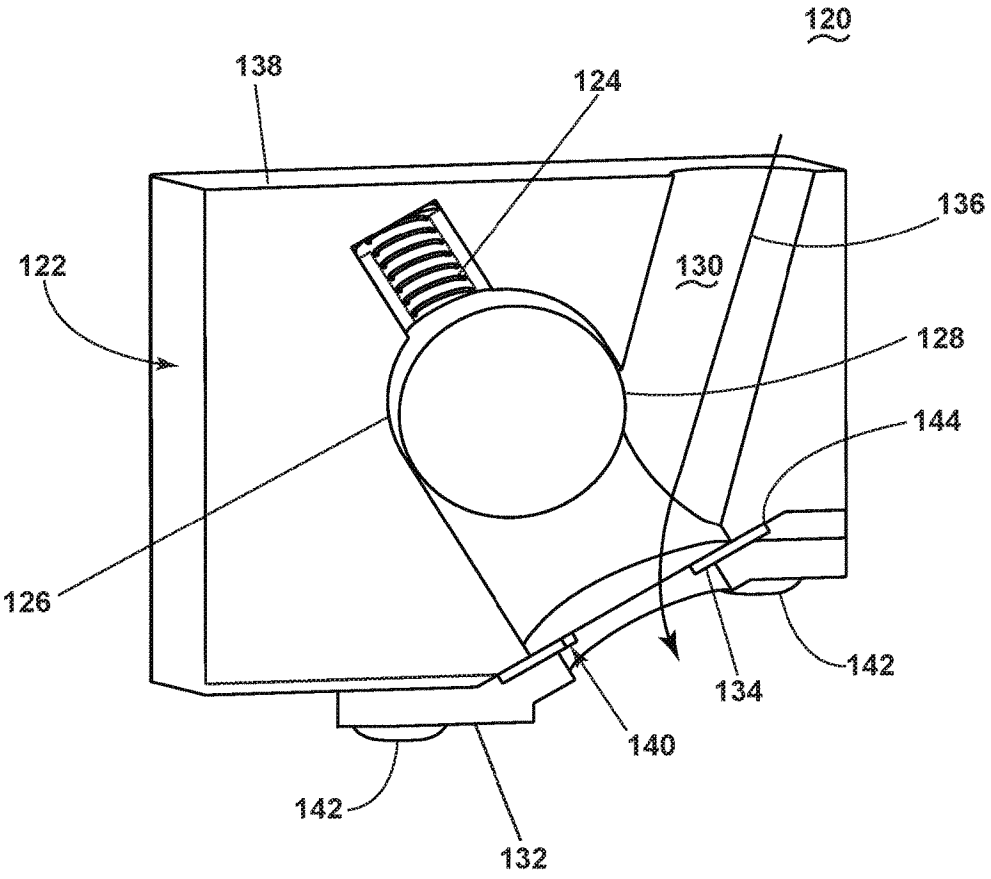
FIG. 4B illustrates an enlarged cross-sectional view of the valve assembly of FIG. 3 in an opened position to define a flow path for liquid from the treating chamber to the tub.

Turning now to FIG. 4B, the valve assembly 120 of FIG. 4A is shown in an opened position. In the opened position, the spring 124 is compressed at least partially, such that the length of the spring 124 in the opened position (FIG. 4B) is less than the length of the spring 124 in the closed position (FIG. 4A). The compression of the spring 124 allows for the ball support 126 and the weighted ball 128 to be positioned away from the through opening 140 of the membrane seal 134. When the weighted ball 128 is positioned away from the through opening 140 of the membrane seal 134, wash liquid is able to flow through the drain channel 130 and exit the valve assembly 120 into the tub 34 along a flow path 136, that is illustrated herein as an arrow.

Turning now to the operation of the valve assembly 120 as illustrated by FIGS. 4A and 4B, the valve assembly 120 operates in a centrifugally-actuated manner. When the valve assembly 120 is in the closed position, as shown in FIG. 4A, wash liquid can flow from the basket drain hole 116 into the housing 122 of the valve assembly 120 via the drain channel 130. However, wash liquid is unable to flow out of the housing 122 and into the tub 34 when the valve assembly 120 is in the closed position, due to the watertight seal that is formed between the weighted ball 128 and the membrane seal 134 as a result of the force of the spring 124 that biases the weighted ball 128 toward the membrane seal 134 and toward closing off the flow of the drain hole 116 into the tub 34. The strength of the spring 124 is selected such that at a first rotational speed, such as the speeds commonly known for use in a wash or a rinse cycle of a washing machine 10, the spring 124 maintains the weighted ball 128 in the position of being biased to move toward and close the through opening 140 of the membrane seal 134.

As the speed of rotation of the rotatable basket 30 approaches a second rotational speed that is greater than the first rotational speed, the centrifugal force of the rotating basket 30 exceeds the biasing force of the spring 124, resulting in the weighted ball 128 compressing the spring 124 and moving away from the through opening 140 of the membrane seal 134. This permits the valve assembly 120 to assume the opened position, allowing flow of wash liquid from the basket drain hole 116 through the drain channel 130 of the housing 122 and out the through opening 140 of the membrane seal 134 and into the tub 34 of the washing machine 10.

In an exemplary embodiment, it is contemplated that the force of the spring 124 will be selected such that the spring 124 will bias the weighted ball 128 against the membrane seal 134 in the closed position at rotational speeds of the basket 30 less than 30 RPM, and that the spring 124 will allow the weighted ball 128 to move away from the membrane seal 134 and assume the opened position at speeds greater than 40 RPM. However, it is also contemplated that these rotational speed values could be any suitable speed such that the valve assemblies 120 occupy the closed position at speeds of rotation of the basket 30 during wash and rinse cycles and that the valve assemblies 120 only occupy the opened position at speeds of rotation greater than those experienced during a wash or rinse cycle and that the basket 30 would only encounter during a spin cycle.

While the valve mechanism for selectively opening or the closing the basket drain holes 116 is illustrated as a centrifugally-actuated valve assembly 120, it is also contemplated that other embodiments of centrifugally-actuated valve mechanisms can be covered by the current disclosure. For example, rather than having discrete valve assemblies 120 as described herein, it is contemplated that the weighted ball 128 need not be contained within an assembly 120 or housing 122 as discussed. Rather, the weighted balls 128 could be provided adjacent the basket drain holes 116 and be biased toward closing the basket drain holes 116 simply by the presence of ramps in the basket bottom wall 20 that direct the weighted ball 128 to be positioned over the drain hole 116 such that wash liquid is not able to flow through the drain hole 116 unless centrifugal forces are sufficient to cause the weighted ball 128 to move away from the drain hole 116. Rather than being biased by a spring or held in place by a housing, the weighted ball 128 can be guided to the home position of closing the drain hole 116 by the geometry of the bottom wall 20 of the basket 30 itself, and move away from the drain hole 116 into the opened position only when sufficient centrifugal force is encountered during the spin cycle of the washing machine 10.

As may be appreciated, the centrifugally-activated valve assembly 120 enables a reduction in the required volume of wash liquid by preventing the wash liquid from draining out of the basket 30 and into the tub 34 when the valve assemblies 120 are in the closed position during wash and rinse cycles of the washing machine 10. By eliminating the need to also fill the volume of the tub 34 up to the level of wash liquid required for the size of the load being washed, the cycle of operation only uses the volume of wash liquid required to fill the basket 30 alone. This results in an overall reduction of wash liquid required to complete a cycle of operation. In embodiments in which the side wall 18 of the basket 30 has no perforations 31 at all, the reduction in wash liquid volume required would be seen with all load sizes. In the case in which a lower portion of the side wall 18 of the basket 30 is imperforate, but perforations 31 are present within the upper portion of the side wall 18 of the basket 30, the reduction in wash liquid volume required would be effective with smaller load sizes, but not larger loads.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance for treating laundry according to a cycle of operation, the laundry treating appliance comprising:

a rotatable basket defining a laundry treating space wherein the rotatable basket includes at least one drain hole;

a tub defining an interior within which the basket is positioned;

a valve assembly fluidly connecting the at least one drain hole with the tub; the valve assembly comprising:

a housing comprising an upper horizontal surface and an angular wall defining a drain channel for diverting wash liquid from the at least one drain hole to an opening at a lower end of the drain channel; the opening at the lower end of the drain channel defined in an angled surface relative to the upper horizontal surface of the housing;

a spring within the housing having a spring compression force; and a weighted object adjacent the compression spring, a portion of which projects from the housing; wherein the housing is shaped and dimensioned to mount to the rotatable basket adjacent the opening at the lower end of the drain channel; the compression spring and the weighted object are configured such that the weighted object closes the opening at the lower end of the drain channel while rotation of the rotatable basket is below a first rotational speed; and the compression spring and the weighted object are configured such that the weighted object moves away from and opens the opening at the lower end of the drain channel as rotation of the rotatable basket approaches a second rotational speed greater than the first rotational speed.

2. The laundry treating appliance of claim 1 wherein the weighted object is biased toward closing the opening at the lower end of the drain channel.

3. The laundry treating appliance of claim 1 wherein the opening at the lower end of the drain channel has a membrane seal and the weighted object moves toward and away from the membrane seal.

4. The laundry treating appliance of claim 1 wherein the weighted object is biased toward the opening at the lower end of the drain channel by the spring.

5. The laundry treating appliance of claim 4 wherein the spring and the weighted object are oriented on an oblique axis relative to the drain channel.

6. The laundry treating appliance of claim 1 wherein the weighted object is a ball formed of stainless steel.

7. The laundry treating appliance of claim 1 wherein the spring compression force is selected to enable the weighted object to move away from the opening at the lower end of the drain channel at the second rotational speed.

8. The laundry treating appliance of claim 7 wherein the second rotational speed is above 25 rpm.

9. The laundry treating appliance of claim 1 wherein the at least one drain hole is located above the opening at the lower end of the drain channel.

10. The laundry treating appliance of claim 1 wherein the valve assembly is located at a bottom of the basket.

11. A method of assembling a laundry treating appliance for treating laundry according to a cycle of operation, comprising:

providing at least one drain hole in a rotatable basket positioned within a tub;

providing a valve assembly fluidly connecting the basket to the tub, the valve assembly comprising:

a housing comprising an upper horizontal surface and an angular wall defining a drain channel for diverting wash liquid from the at least one drain hole to an opening at a lower end of the drain channel; the opening at the lower end of the drain channel defined in an angled surface relative to the upper horizontal surface of the housing;

a spring within the housing and having a spring compression force; and a weighted object adjacent the spring, a portion of which projects from the housing; and mounting the valve assembly adjacent the opening at a lower end of the drain channel;

wherein the weighted object is positioned to move toward and close the opening at a lower end of the drain channel in the angled surface while rotation of the rotatable basket is below a first rotational speed and to move away from and open the opening at a lower end of the drain channel in the angled surface as rotation of the rotatable basket approaches a second rotational speed greater than the first rotational speed.

12. The method of assembling a laundry treating appliance of claim 11 wherein the spring and the object are oriented on an oblique axis relative to the drain channel.

13. The method of assembling a laundry treating appliance of claim 11 wherein the spring compression force is selected to enable the weighted object to move away from the opening at a lower end of the drain channel at the second rotational speed.

14. The method of assembling a laundry treating appliance of claim 11 wherein the weighted object is a ball formed of stainless steel.

15. The method of assembling a laundry treating appliance of claim 11 further comprising mounting a membrane seal around the opening at a lower end of the drain channel.

* * * * *